US005340336A

United States Patent [19]

Menechella

[11] Patent Number: 5,340,336

[45] Date of Patent: Aug. 23, 1994

[54] ELECTRICAL CONNECTOR

[75] Inventor: Gino Menechella, Richmond Hill, Canada

[73] Assignee: The Whitaker Corporation, Wilmington, Del.

[21] Appl. No.: 99,279

[22] Filed: Jul. 29, 1993

[51] Int. Cl.[5] ..... H01R 4/50

[52] U.S. Cl. ..... 439/783; 439/863

[58] Field of Search ..... 439/783, 807, 820, 836, 439/863

[56] References Cited

U.S. PATENT DOCUMENTS

| | | | |
|---|---|---|---|
| 3,504,332 | 3/1970 | Mixon | 439/863 X |
| 4,415,222 | 11/1983 | Polidori | 339/270 R |
| 4,600,264 | 7/1986 | Counsel | 339/247 |
| 4,915,653 | 4/1990 | Mair | 439/783 X |
| 5,006,081 | 4/1991 | Counsel et al. | 439/783 |
| 5,145,420 | 9/1992 | Counsel et al. | 439/783 |

OTHER PUBLICATIONS

Senior Industries, p. 10, 610 Pond Drive, Wood Dale, Illinois 60191.

*Primary Examiner*—Eugene F. Desmond

[57] ABSTRACT

A connector 10 is disclosed of the type that interconnects and mechanically secures two electrical conductors together, particularly non-insulated, flat ribbon conductors 46. The connector includes a C-shaped clamping member 42 and a wedge 44 that is conformably received therewithin thereby forming a conductor receiving channel on each side of the wedge 44, between the wedge 44 and the walls of the clamping member 42. As the wedge 44 is forced into the clamping member 42 the walls are elastically deflect outwardly, applying substantial force against the conductors, thereby establishing good electrical contact and a strong mechanical interconnection of the two conductors. The connector 10 is self aligning for a variety of conductor sizes where at least one is a flat conductor. This is achieved by means of a novel combination of concave and convex surfaces on the clamping member and a pair of flat converging surfaces on the wedge, one of which includes a concave portion.

12 Claims, 4 Drawing Sheets

ELECTRICAL CONNECTOR

FIELD OF THE INVENTION

The present invention is related to electrical connectors of the type that interconnect and mechanically secure two electrical conductors together, particularly non-insulated conductors.

BACKGROUND OF THE INVENTION

Connectors for electrically commoning and mechanically securing two electrical wires together are well known in the industry, particularly in the power utility industry. Such connectors typically include a C-shaped clamping member and a wedge shaped member to be conformably received within the C-shaped member. Suitable radiused surfaces are provided in the interior of the C-shaped member and the opposing surfaces of the wedge to receive and clamp the wires. Examples of these connectors are disclosed in U.S. Pat. Nos. 4,415,222 and 4,600,264. These patents teach a, connector having a C-member with a slidable wedge that is movable into the C-member by means of a screw. The two wires are interposed between concave surfaces formed in the C-member and the wedge and are tightly locked in place when the screw is tightened to force the wedge into the C-member. More recent examples of similar connectors are disclosed in U.S. Pat. Nos. 5,006,081 and 5,145,420. The '081 patent discloses a C-member connector for interconnecting two relatively smaller diameter wires which includes a locking device for locking the two parts of the connector together. The '420 patent discloses a C-member connector wherein the bottom of the wedge is in engagement with the inner surface of the bottom of the C-member to minimize bowing thereof and thereby substantially increase the clamping force applied to the wires. A typical prior art C-connector 10 is shown in FIG. 1. The connector 10 has a C-member 12 and a wedge 14 where the C-member 12 includes upturned ends 16 that form channels for receiving a pair of round wires 18 that are to be interconnected. The channels converge from the front end 20 to the rear end 22. The wedge 14 includes concave surfaces 24, one on each side, that engage the wires 18 and force them into the channels when the wedge is forced into the C-member 12. A projection 26 in the wedge engages an opening 28 in the C-member to secure the assembly together. All of the above discussed connectors are designed specifically for solid round wires or stranded round cables.

However, conductors having relatively flat rectangular cross-sectional shapes are currently in use as ground and power buses. Such buses need to be tapped on occasion, and the only connector device currently available for this is a U-shaped member having a screw threaded into each side. The two flat conductors are inserted, side by side, into the interior of the U-shaped member and the screws tightened against the surfaces of the conductors to a specific value of torque. Controlling torque in these situations in the field is difficult and sometimes not accomplished resulting in damaged conductors, poor electrical connections, or poor mechanical connections. The alternative to using these connectors is to solder the connections. However, this can be very cumbersome in the field because gas tanks and other relatively heavy equipment must be transported to the work site which is frequently in relatively confined areas such as manholes. What is needed is a C-member type connector that will accept the flat ribbon conductors and electrically interconnect them while providing sufficient frictional force to secure them together without danger of damage to them. Preferably such a connector may be assembled by hand with the use of only a pair of pliers.

SUMMARY OF THE INVENTION

A connector is disclosed to electrically interconnect two electrical conductors and to mechanically secure them together, wherein one of the electrical conductors is relatively flat having a substantially elongated cross-sectional shape. The connector includes a clamping member having a base and two spaced walls extending upwardly from the base that terminate in mutually opposed edges that curve toward each other. The walls converge from a first end of the base toward a second end thereof, each wall having a concave surface near the base and a convex surface between the concave surface and the opposing edge. The two convex surfaces are mutually opposed. A wedge, adapted to be conformably received in the clamping member, has first and second opposite surfaces which converge from a first end of the wedge toward a second end thereof. The wedge and the clamping member are arranged so that when the wedge is inserted into the clamping member, the first surface of the wedge urges the one conductor into electrical engagement with the convex surface of one of the walls of the clamping member and the second surface urges the other of the conductors into electrical engagement with the other of the walls of the clamping member.

DESCRIPTION OF THE PREFERRED EMBODIMENT

Figure 1:
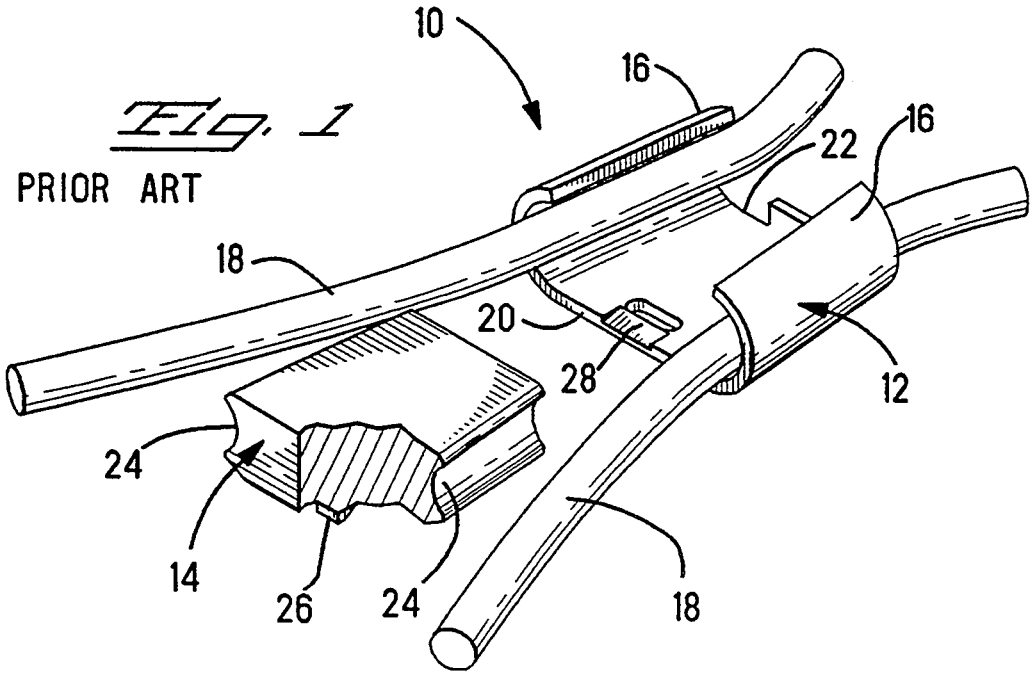
Fig. 1 PRIOR ART
FIG. 1 is an isometric exploded view of a prior art C-connector.
Figure 2:
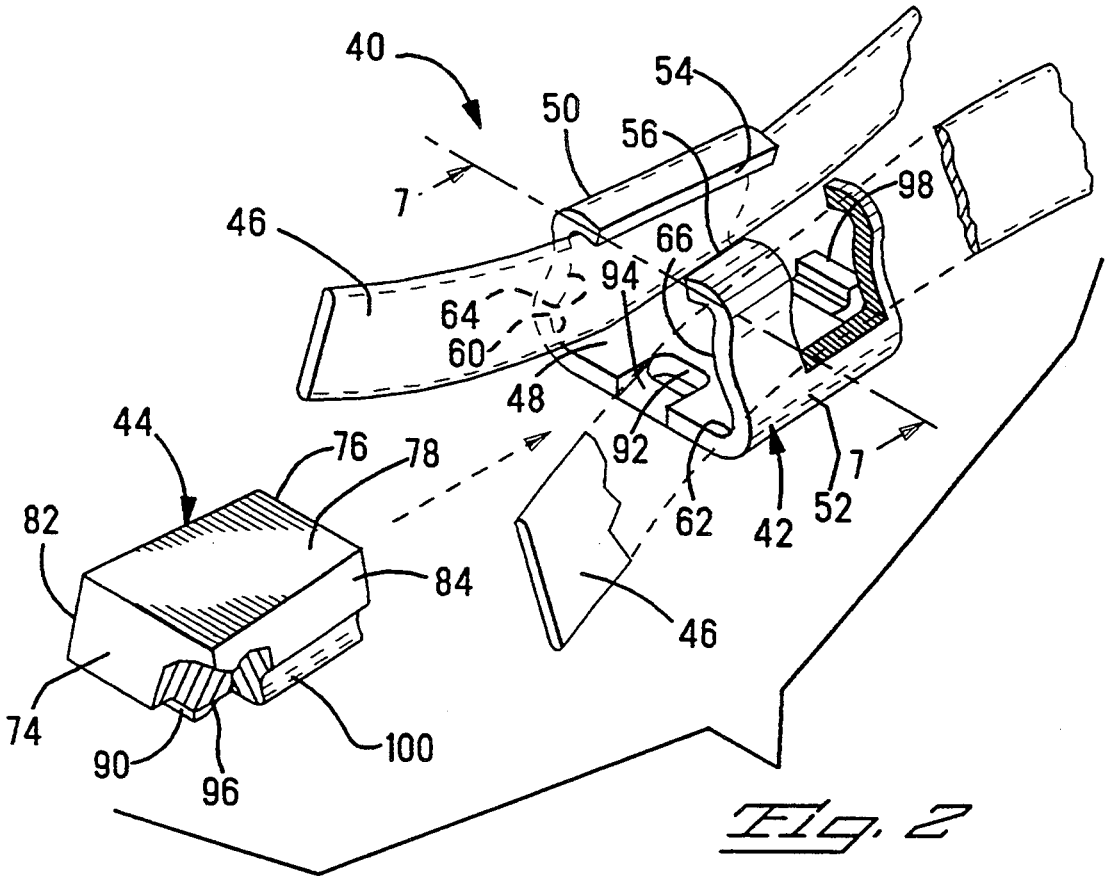
FIG. 2 is an isometric exploded view of a connector incorporating the teachings of the present invention.

There is shown in FIG. 2 a connector 40 incorporating the teachings of the present invention.

Figure 3:
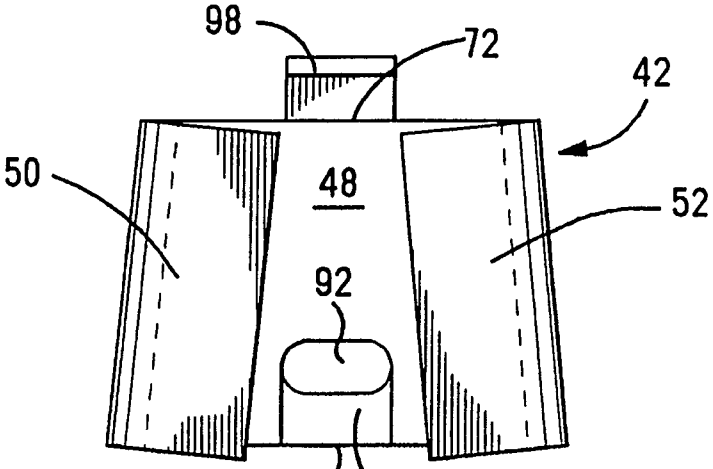
FIG. 3 is a top plan view of the clamping member shown in FIG. 2.
Figure 4:
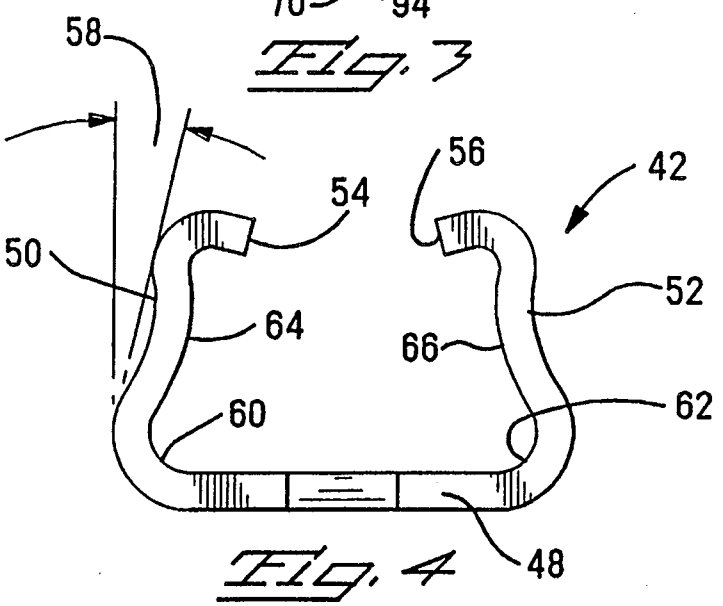
FIG. 4 is an end view of the clamping member shown in FIG. 3.

The connector 40 includes a clamping member 42 and a wedge 44. A pair of relatively flat ribbon conductors 46, each having a substantially elongated shape, are shown in position within the clamping member 42 with the wedge 44 in position to be inserted into the clamping member. The clamping member 42, as best seen in FIGS. 3 and 4, includes a base 48 and two walls or arms 50 and 52 extending upwardly from the base and terminating in mutually opposed edges 54 and 56 that curve toward each other as shown. The two walls 50 and 52 are each tilted inwardly from the vertical as shown at 58 (FIG. 4), for a purpose that will become apparent. The angle 58, in the present example, is about 11 degrees, however, it will be understood that this exact angle is not critical and may vary somewhat. The walls 50 and 52 and the base 48 are formed from a single piece so that concave surfaces 60 and 62 are formed at the junctures. The walls are then bowed inwardly slightly to form mutually opposing convex surfaces 64 and 66 between the curved edges 54,56 and the concave surfaces 60,62 respectively. In addition to the walls 50 and 52 tilting inwardly toward each other by the amount of the angle 58, they also converge from a first end 70 to a second end 72. The clamping member is made from a ¾ hard copper alloy CDA 195, per ASTM Specification No. B465. This material has a copper content of 95 percent and provides excellent spring characteristics. Other suitable materials having good electrical and spring characteristics, however, may be substituted.

Figure 5:
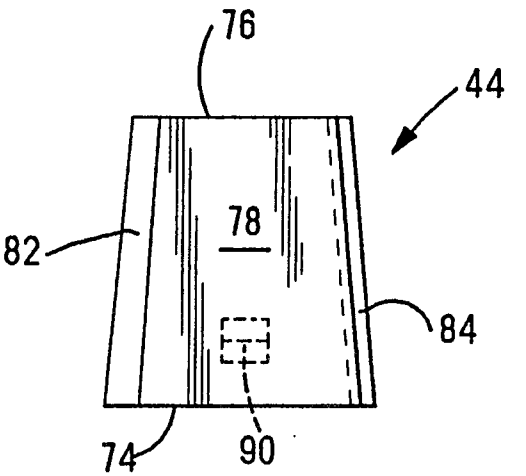
FIG. 5 is a top plan view of the wedge shown in FIG. 2.
Figure 6:
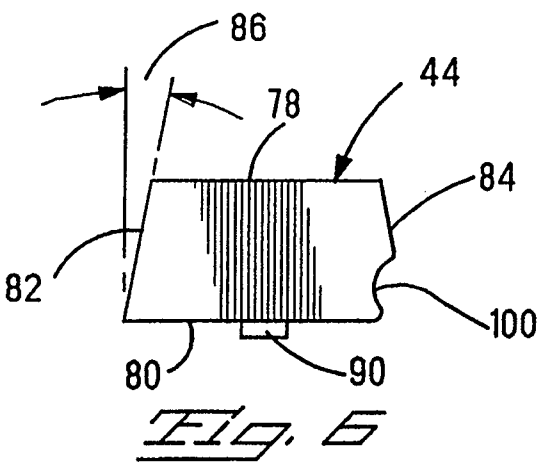
FIG. 6 is an end view of the wedge shown in FIG. 5.

The wedge 44, as best seen in FIGS. 5 and 6, having a first end 74 and a second end 76, includes a top surface 78, a bottom surface 80, and substantially flat side surfaces 82 and 84. The two side surfaces 82 and 84 converge from the first end 74 of the wedge to the second end 76 by an amount substantially the same as the convergence of the walls 50 and 52 from the end 70 of the clamping member to the end 72. The two side surfaces also tilt toward each other somewhat at the top surface 78 The two side surfaces 82 and 84 are each tilted inwardly from the vertical, as shown at 86, by an amount of about 11.0 degrees, similar to the tilting of the walls 50 and 52. The length of the wedge 44 is substantially the same as the length of the clamping member 42. The converging and the tilting of the side surfaces 82 and 84 conforms to the converging and tilting of the walls 50 and 52 so that the wedge 44 may be conformably received into the clamping member. Referring now to FIGS. 2 through 6, a projection 90 extending from the bottom surface of the wedge 44 is arranged to snap into an opening 92 in the base 48 of the clamping member 42 when the two parts are forced together, thereby locking them in place. A bevel 94 in the edge of the base 48 and another bevel 96 on the projection 90 aid in assembly. A tab 98, extending from clamping member base 48 and bent upwardly, serves as a stop for the wedge 44 to prevent over insertion into the clamping member. The second surface 84 of wedge 44 also includes a concave portion 100 that is formed therein for the length of the second surface. The concave portion 100 is arranged opposite the concave surface 62 of the clamping member 42 when the wedge is in place in the clamping member. The wedge is made of a die cast copper alloy CDA 875 having a copper content of 80 percent or greater, or other suitable material.

Figure 7:
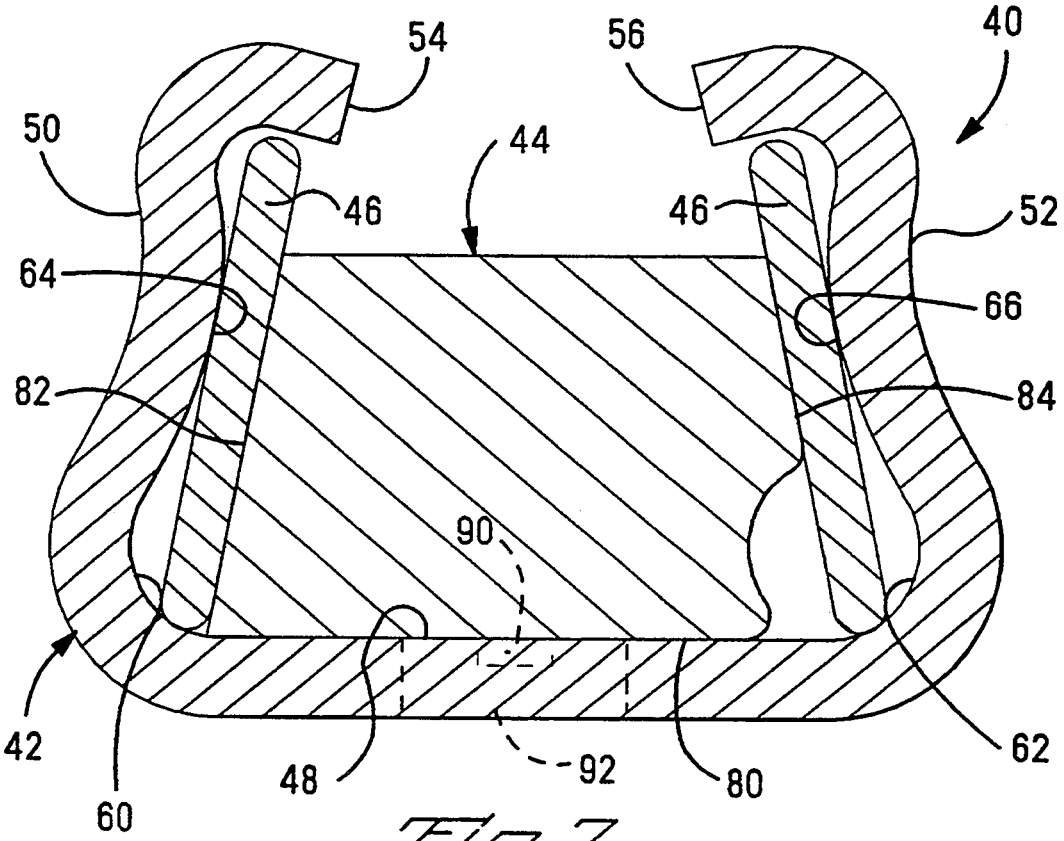
FIG. 7 is a cross-sectional view taken along the lines 7—7 of FIG. 2 showing the connector interconnecting two flat conductors.
Figure 8:
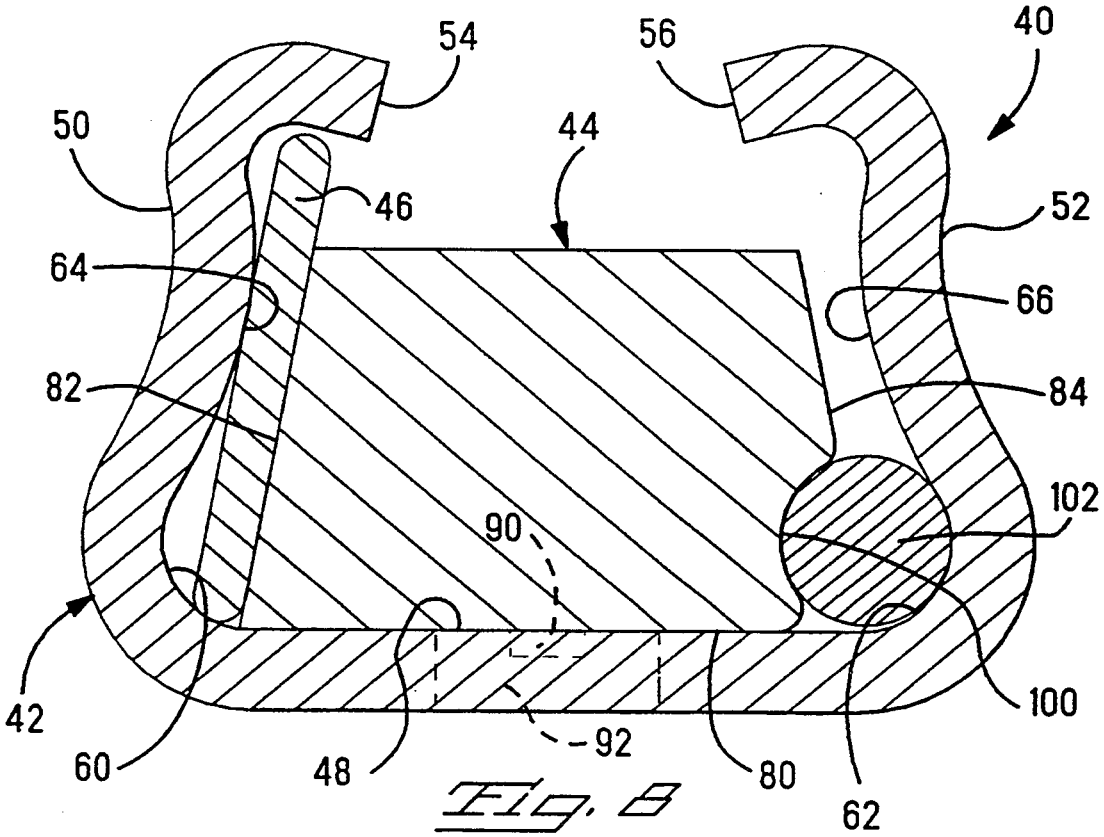
FIGS. 8 and 9 are views similar to that of FIG. 7 showing the connector interconnecting a flat conductor and a round conductor.
Figure 9:
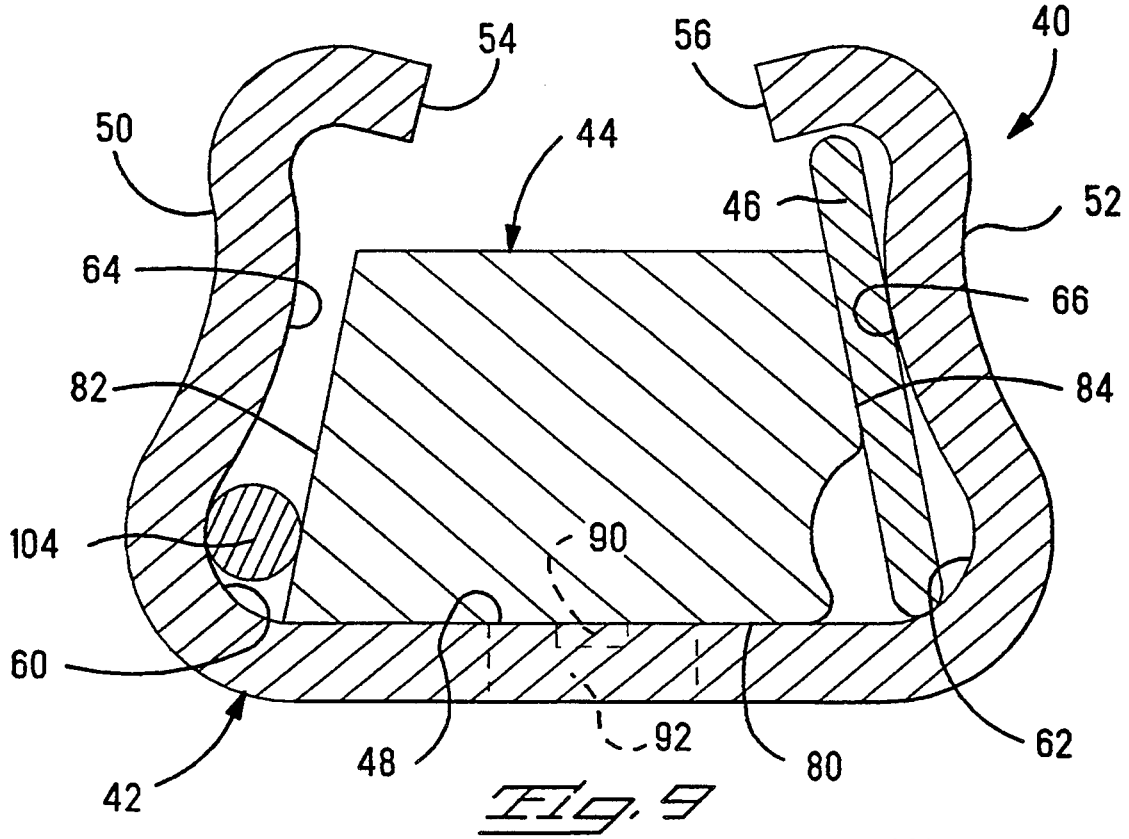

FIGS. 7, 8, and 9 are cross-sectional views showing the connector 40 fully assembled with conductors in place for three different configurations of conductors. The two side surfaces 82 and 84 of the wedge 44 and the convex and concave surfaces 60 through 66 of the clamping member 42 define channels for receiving the conductors to be interconnected. The first configuration is shown in FIG. 7 where the connector 40 interconnects two flat ribbon conductors 46, similar to those shown in FIG. 2, having substantially elongated cross-sectional shapes. The arms 50 and 52 are forced outwardly away from each other as the wedge 44 is forced into the clamping member 42, sandwiching the conductors 46 between the wedge 44 and the walls of the clamping member 42. The convex surfaces 64 and 66 are positioned so that they engage the sides of the ribbon conductors 46 and urge them into pressing engagement with the side surfaces 82 and 84 of the wedge 44. When the wedge 44 is fully inserted the projection 90 snaps into the opening 92, shown in phantom in FIG. 7. The wedge is forced into the clamping member by means of a pair of pliers that are manually operated. The energy stored in the forced apart arms 50 and 52 is sufficient to electrically and mechanically interconnect the two conductors. However, the projection 90 being in the opening 92 is relied upon to maintain the wedge 44 in position within the clamping member 42. With respect to mechanical interconnection, by way of example, two ribbon conductors 0.050 inch thick and 0.500 inch wide interconnected in this way can withstand a tensile force of a minimum of about 100 pounds. The arms 50 and 52, in the present example, are elastic enough to allow for flat conductors having a thickness range of about 0.032 inch to about 0.093 inch. As long as the conductors are within this range they will be self aligning when forced against the side surfaces of the wedge by the urging of the convex surfaces 64 and 66. The curved ends 54 and 56 of the walls are spaced from the base 48 so that the edges of the flat ribbon conductors are confined therebetween yet with sufficient clearance so that the conductors will not bind or become damaged during assembly of the connector 40 thereto. Since the two side surfaces 82 and 84 of the wedge and the two arms 50 and 52 of the clamping member are tilted off vertical by the angles 58 and 86 respectively, as shown in FIGS. 4 and 6, the convex surfaces 64 and 66, due to the stored energy in the arms, force the bottom surface of the wedge into engagement with the base 48. This assures that the projection 90 remains within the opening 92. It also helps to prevent bowing of the base 48 thereby substantially increasing the force required to deflect the arms outwardly by the wedge, which in turn increases the amount of energy stored in the deflected arms.

The second configuration is shown in FIG. 8 where the connector 40 interconnects a flat ribbon conductor 46 to a round conductor 102, which may be either a solid or stranded conductor. In the present example the round conductor may be a number 6 gage or a number 8 gage wire. As the wedge is inserted into the clamping member, the arm 50 deflects as in the example of FIG. 7, however, the arm 52 deflects very little since the round conductor 102 is trapped between the two convex surfaces 62 and 100. In this case, most of the stored energy that is applied to electrically and mechanically interconnect the two conductors is in the arm 50.

The third configuration is shown in FIG. 9 where the connector 40 interconnects a flat ribbon conductor 46 to a smaller round conductor 104, which may be either a solid or stranded conductor. In the present example the round conductor may be a number 10 gage or a number 12 gage wire. Note that in this case, the round conductor is positioned on the opposite side of the connector 40 adjacent the concave surface 60. As the wedge 44 is inserted into the clamping member 42, the arm 52 deflects as in the example of FIG. 7, however, the arm 50 deflects very little since the round conductor 104 is trapped between the convex surface 60 and the side surface 82 of the wedge 44. In this case, most of the stored energy that is applied to electrically and mechanically interconnect the two conductors is in the arm 52. This arrangement of the concave surface 100 opposing the concave surface 62 on the one side of the connector 40, and the concave surface 60 opposing the flat side 82 on the other side of the connector and the ability to position the flat ribbon conductor optionally on either side, provides a substantial range of conductor sizes that can be accommodated.

Figure 10:
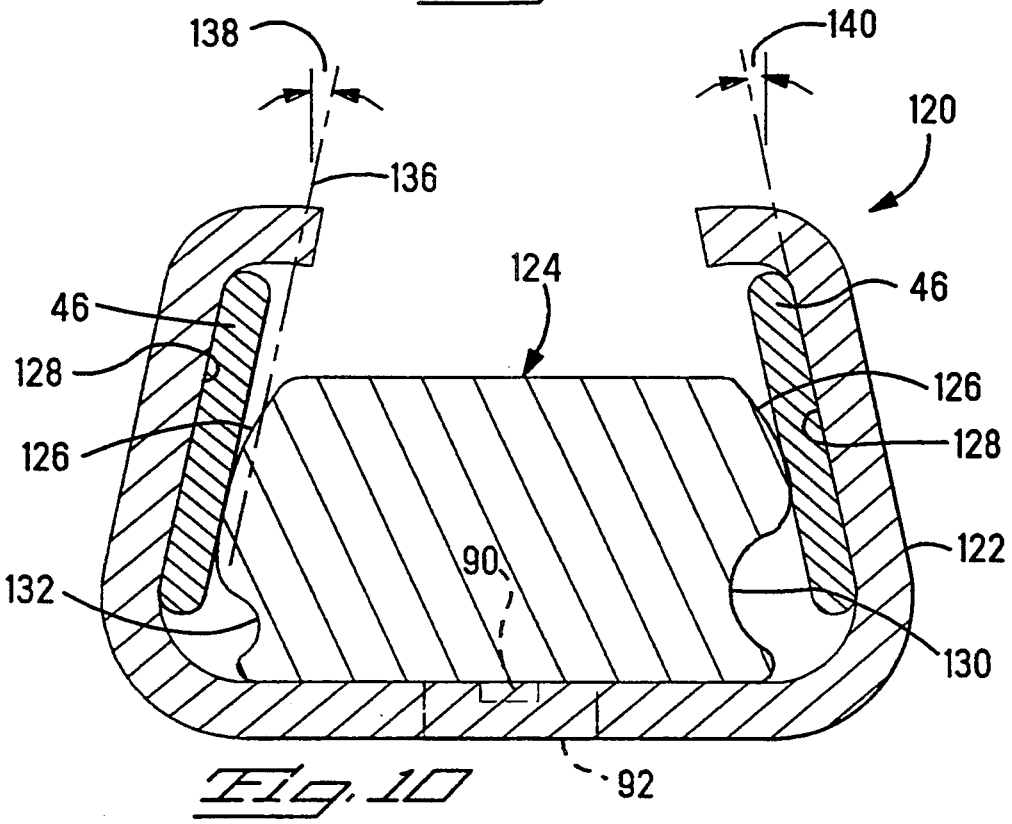
FIG. 10 is a view similar to that of FIG. 7 showing another embodiment of the present invention.

Another embodiment of the present invention is shown in FIG. 10 which is a cross-sectional view similar to that of FIG. 7 showing the first configuration, interconnecting two flat ribbon conductors 46. There is shown in FIG. 10 a connector 120 having a clamping member 122 and a wedge 124 that are similar to the clamping member 42 and the wedge 44, respectively, except that the wedge 124 has two side surfaces 126 that are convex rather than flat and the clamping member 122 has two walls 128 that are flat rather than convex. The wedge 124, in addition to having a concave surface 130 in one side surface that corresponds to the concave surface 100 of the wedge 44, the opposite side surface has a smaller concave surface 132 formed therein. The concave surface 130 receives larger round conductors in the range of 6 to 8 gage while the concave surface 132 receives smaller conductors in the range of 10 to 12 gage. The convex surfaces 126 of the wedge 124 have a chord 136 that tilts inwardly as shown at 138 about 11.0 degrees, substantially the same as the tilting of the side surfaces of the wedge 44. The flat surfaces of the walls 128 also tilt inwardly as shown at 140 about 11 degrees, substantially the same as the tilting of the walls of the clamping member 42.

When inserting the wedge 124 into the clamping member 122 the arms 128 are forced outwardly away from each other as the wedge is forced into the clamping member, sandwiching the conductors 46 between the wedge and the walls of the clamping member. The convex surfaces 126 are positioned so that they engage the sides of the ribbon conductors and urge them into pressing engagement with the flat surfaces of the walls 128 of the clamping member in a manner similar to that of the connector 40. When the wedge is fully inserted the projection 90 snaps into the opening 92. The wedge is forced into the clamping member by means of a pair of pliers that are manually operated. The energy stored in the forced apart walls 126 is sufficient to electrically and mechanically interconnect the two conductors. All other aspects of the structure and operation of the connector 120 are similar to those of the connector 40. As with the connector 40, the walls 128 of the connector 120 are elastic enough to allow for flat conductors having a thickness range of about 0.032 inch to about 0.093 inch. As long as the conductors are within this range they will be self aligning when forced against the flat surfaces of the walls 128 by the urging of the convex surfaces 126.

While the first configuration has been described with respect to the second embodiment, it will be understood that the second and third configurations shown in FIGS. 8 and 9 will easily be accommodated by the structure of the second embodiment. Such accommodation will permit the interconnection of a flat conductor to any of a range of round conductors from 6 gage to 12 gage.

An important advantage of the present invention is that the connector will interconnect two flat ribbon conductors or one flat conductor and one round conductor. The connector is easily assembled in the field by just a pair of pliers. Additionally, excellent electrical contact is made as well as a good mechanically strong interconnection without damage to the conductors. This makes this connector suitable for both low and high current applications.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. A connector to electrically interconnect two electrical conductors and to mechanically secure them together, wherein one of said electrical conductors is relatively flat having a substantially elongated cross-sectional shape, comprising:

(a) a clamping member having a base and two spaced walls extending upwardly from said base that terminate in mutually opposed edges, said walls converging from a first end of said base toward a second end thereof, each said wall having a contact surface of which a first portion is concave and adjacent said base and a second portion is between said first portion and its respective said opposing edge, said second portions of said two walls being mutually opposed; and (b) a wedge, adapted to be conformably received within said clamping member, having first and second opposite side surfaces which converge from a first end of said wedge toward a second end thereof, so that when said wedge is inserted into said clamping member said side surface of said wedge urges said one flat conductor into electrical engagement with said second portion of said contact surface of one of said walls, wherein one of said side surface and said second portion of said contact surface is convex, and said second side surface urges the other of said conductors into electrical engagement with said contact surface of the other of said walls of said clamping member.

2. The connector according to claim 1 wherein said clamping member and said wedge sufficiently interfere such that said urging of said conductors into electrical engagement with said contact surfaces of said walls effects said mechanically securing of said conductors together.

3. The connector according to claim 1 wherein said second side surface of said wedge includes a concave portion opposite said concave first portion of said contact surface of one of said walls of said clamping member for receiving a round conductor.

4. The connector according to claim 1 wherein one of said second portions of said contact surfaces includes a convex portion and one of said first and second side surfaces of Said wedge includes a substantially flat portion that is opposite said convex portion of its respective adjacent said wall, thereby establishing a channel for receiving said one of said electrical conductors.

5. The connector according to claim 1 wherein one of said second portions of said contact surfaces includes a substantially flat portion and one of said first and second side surfaces of said wedge includes a convex portion that is opposite said substantially flat portion of its respective adjacent said wall, thereby establishing a channel for receiving said one of said electrical conductors.

6. The connector according to claim 1 wherein said first and second side surfaces converge from the bottom to the top of said wedge, and said walls of said clamping member converge from said base to said mutually opposed edges in conformance to said first and second side surfaces so that said wedge is urged against said base of said clamping member.

7. The connector according to claim 1 wherein said concave first portion of said contact surface of one wall and one of said side surfaces of said wedge cooperate to trap and secure a round conductor therebetween.

8. The connector according to claim 1 wherein said mutually opposed edges are arranged to confine said wedge and said one electrical conductor between said base and said opposed edges.

9. The connector according to claim 1 wherein said two walls are beams which are elastically deflected outwardly upon insertion of said wedge and said conductors into said clamping member thereby storing energy in said beams, and said contact surface of one of said walls is arranged so that the stored energy forces said one flat conductor into electrical and mechanically secured engagement with one of said first and second side surfaces of said wedge.

10. The connector according to claim 9 wherein said other conductor is relatively flat having a substantially elongated cross-sectional shape, and wherein said convex surface of the other of said walls is arranged so that said stored energy forces said other conductor into electrical and mechanically secured engagement with the other of said first and second side surfaces of said wedge.

11. The connector according to claim 1 wherein said base of said clamping member includes an opening therethrough and said wedge includes a projection extending through said opening for locking said clamping member, said wedge, and said two conductors together.

12. A connector to electrically interconnect two electrical conductors and to mechanically secure them together, wherein one of said electrical conductors is relatively flat having a substantially elongated cross-sectional shape, comprising:

(a) a clamping member having a base and two spaced walls extending upwardly from said base that terminate in mutually opposed edges that curve toward each other, said walls converging from a first end of said base toward a second end thereof, each said wall having a concave surface near said base and a convex surface between said concave surface and said opposing edge, said two convex surfaces being mutually opposed; and (b) a wedge, adapted to be conformably received in said clamping member, having first and second opposite side surfaces which converge from a first end of said wedge toward a second end thereof, so that when said wedge is inserted in said clamping member said first side surface of said wedge urges said one conductor into electrical engagement with said convex surface of one of said walls of said clamping member and said second side surface urges the other of said conductors into electrical engagement with the other of said walls of said clamping member thereby causing said walls to elastically deform outwardly.

* * * * *